US010538294B2

(12) United States Patent
Amaro

(10) Patent No.: US 10,538,294 B2
(45) Date of Patent: Jan. 21, 2020

(54) URBAN WATERCRAFT

(71) Applicant: Arnaldo Amaro, São Paulo (BR)

(72) Inventor: Arnaldo Amaro, São Paulo (BR)

( * ) Notice: Subject to any disclaimer, the term of this patent is extended or adjusted under 35 U.S.C. 154(b) by 0 days.

(21) Appl. No.: 16/091,517

(22) PCT Filed: Mar. 20, 2017

(86) PCT No.: PCT/BR2017/050064
§ 371 (c)(1),
(2) Date: Oct. 4, 2018

(87) PCT Pub. No.: WO2017/177293
PCT Pub. Date: Oct. 19, 2017

(65) Prior Publication Data

US 2019/0127029 A1 May 2, 2019

(30) Foreign Application Priority Data

Apr. 12, 2016 (BR) ..... 20 2016 008084 9

(51) Int. Cl.
*B63B 1/12* (2006.01)
*B63B 35/00* (2006.01)
(Continued)

(52) U.S. Cl.
CPC ..... *B63B 35/00* (2013.01); *B63B 1/121* (2013.01); *B63B 19/00* (2013.01); *B63B 19/08* (2013.01);
(Continued)

(58) Field of Classification Search
CPC ..... B63B 1/107; B63B 1/12; B63B 1/121; B63B 2001/123; B63B 1/125;
(Continued)

(56) References Cited

U.S. PATENT DOCUMENTS 3,354,857 A * 11/1967 Hobday ..... B63B 1/30 114/282
3,517,632 A * 6/1970 Gray ..... B63B 1/22 114/283
(Continued)

*Primary Examiner* — Andrew Polay
(74) *Attorney, Agent, or Firm* — Luoh J. Wu; Continent Patent Office LLP

(57) ABSTRACT

It relates to an urban craft, which belongs to the industrial sector of nautical vehicles for transportation of crew and passengers in general, composed of a speedboat (1) equipped with a central cab (2), a transparent roof (3), a honeycomb grid (4), an X-shaped structure (5), faceted areas (6), a catamaran hull (7), an inverted nose (8), a negative bow (9), engines (10), a propeller (11), seats (12), safety belts, airbags, acceleration and braking pedals (13), a steering wheel (14), a dashboard (15), a central console (16), a gear shift lever (17), armrests (18), cupholders (19), internet/Wi-Fi access, detachable tablets (20), a lateral boarding platform (21), headlights (22) and lateral arrows in the camera-based rearview mirrors (23), an air-conditioning system, a pneumatic suspension system with adjustable airbags and hydrogen-based shock absorbers, individual (rear and front) lateral doors (24), large gullwing lateral doors (25), an upper airfoil (26), a rear window (27), a foldable rear platform (28) with a step over the propelling devices (29), a central watershed system (30), a panoramic front window (31), a front hood with luggage compartment and access to fuel supply, a rear camera (32).

1 Claim, 12 Drawing Sheets

Figure 1:
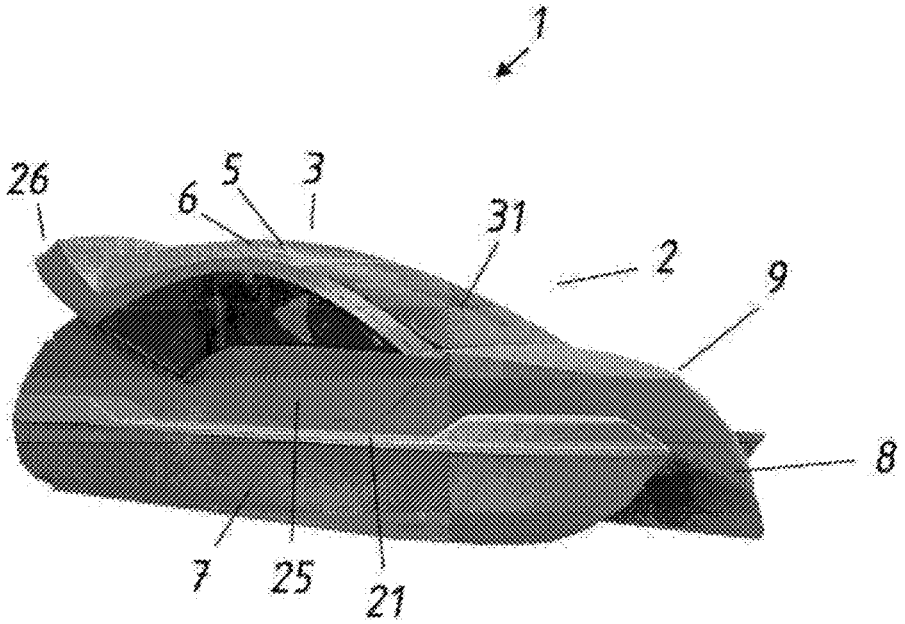
Figure 2:
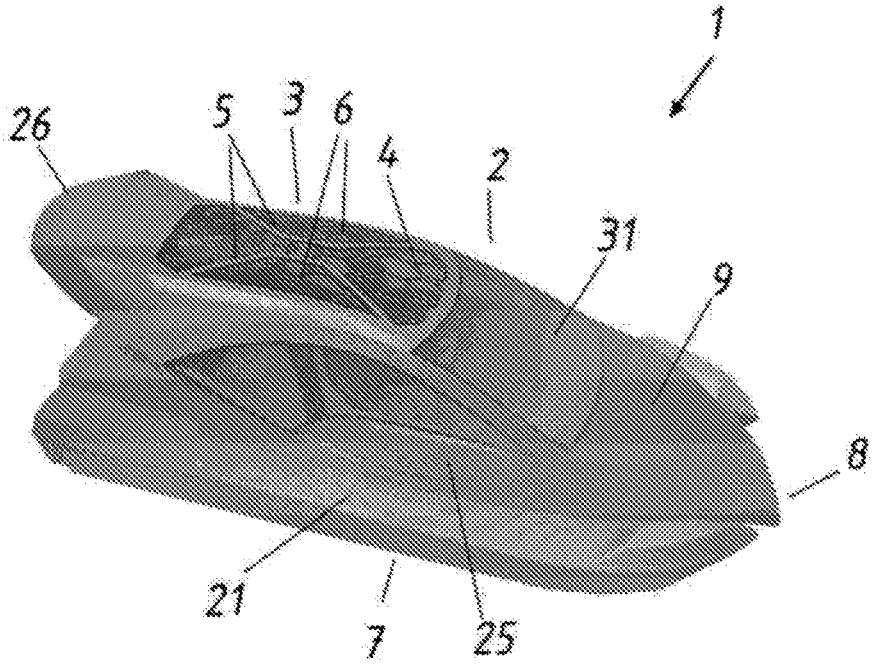
Figure 3:
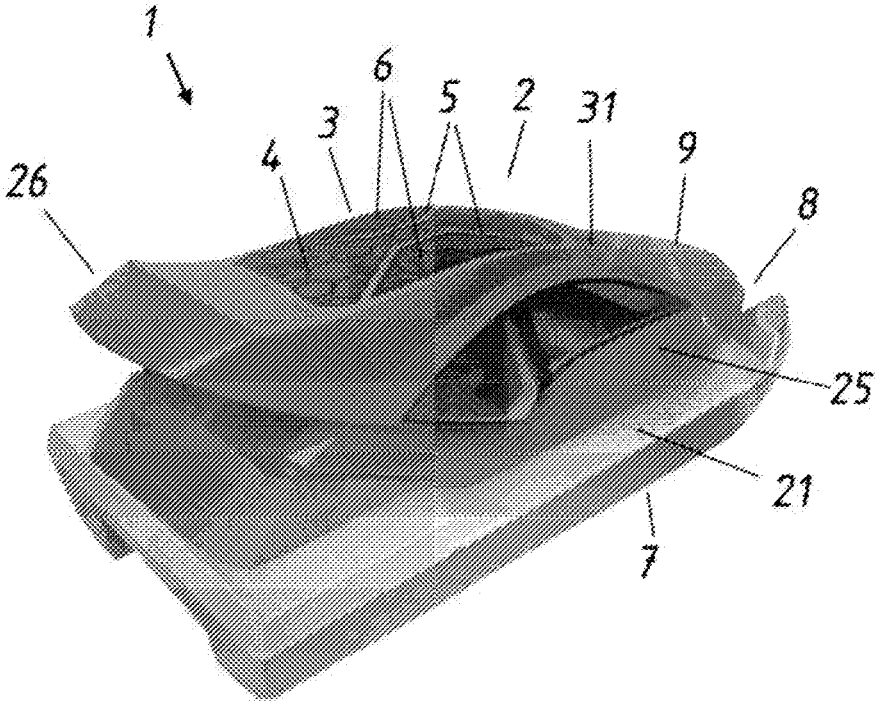
Figure 4:
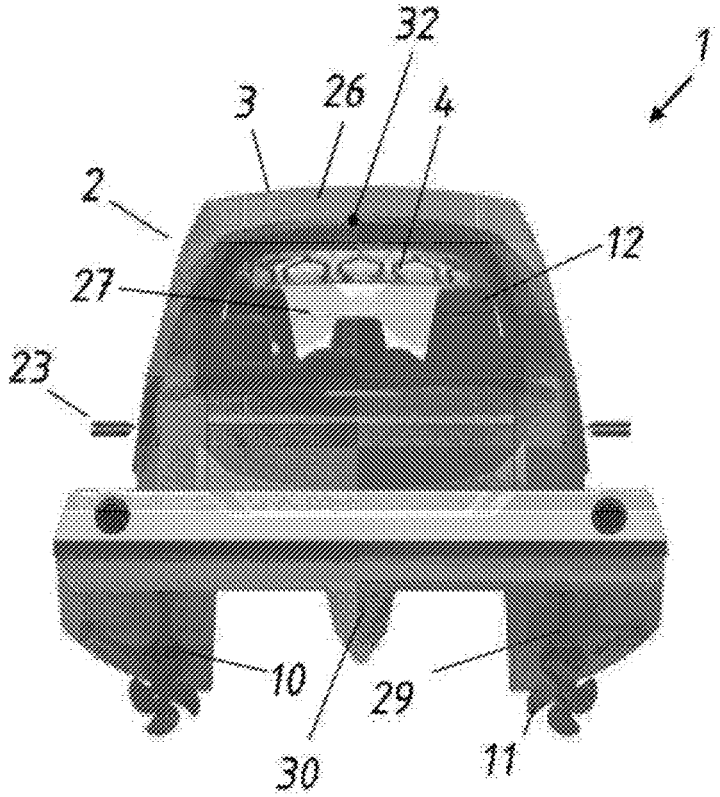
Figure 5:
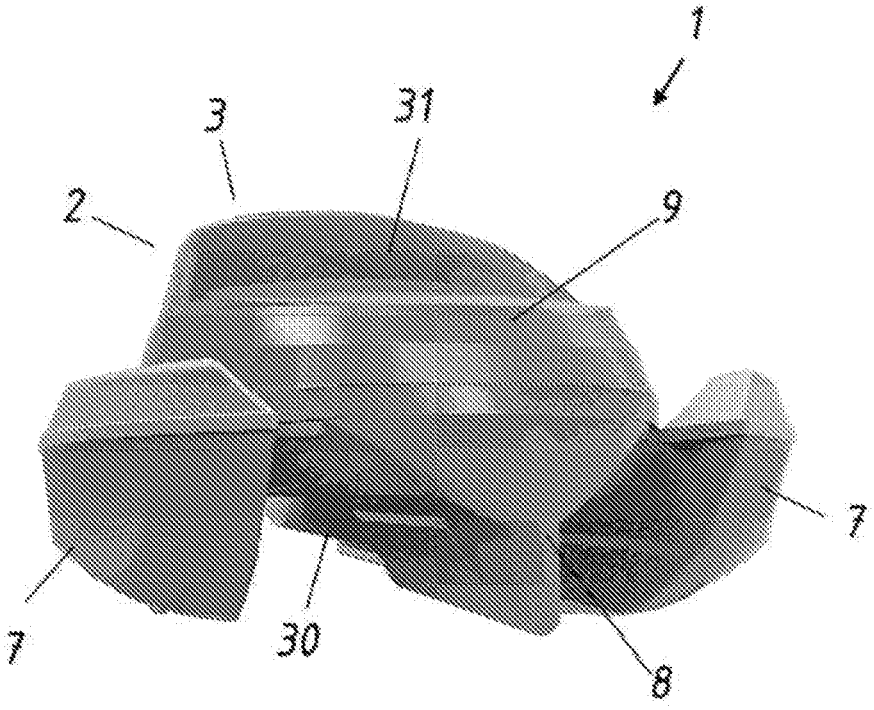
Figure 6:
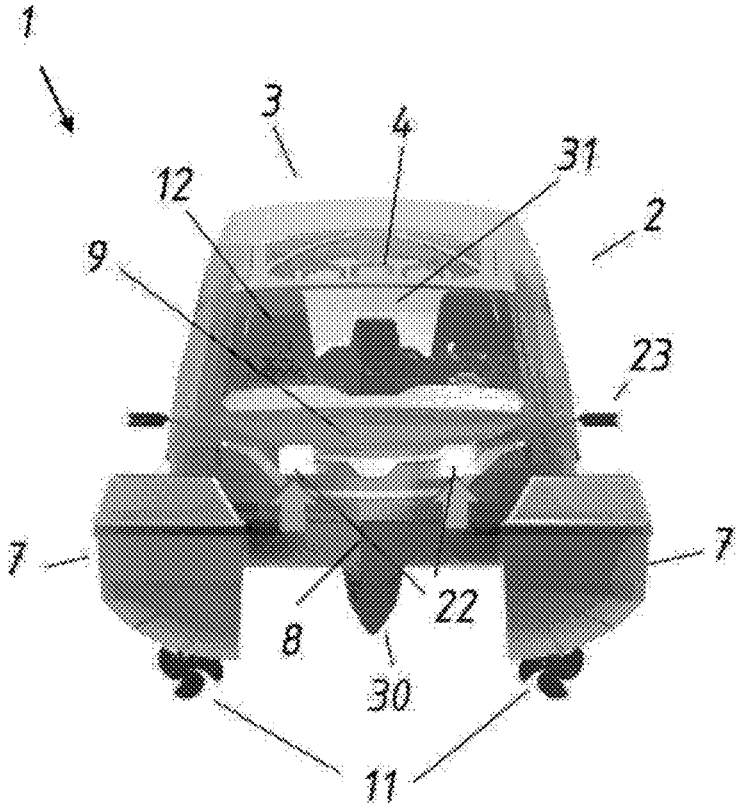
Figure 7:
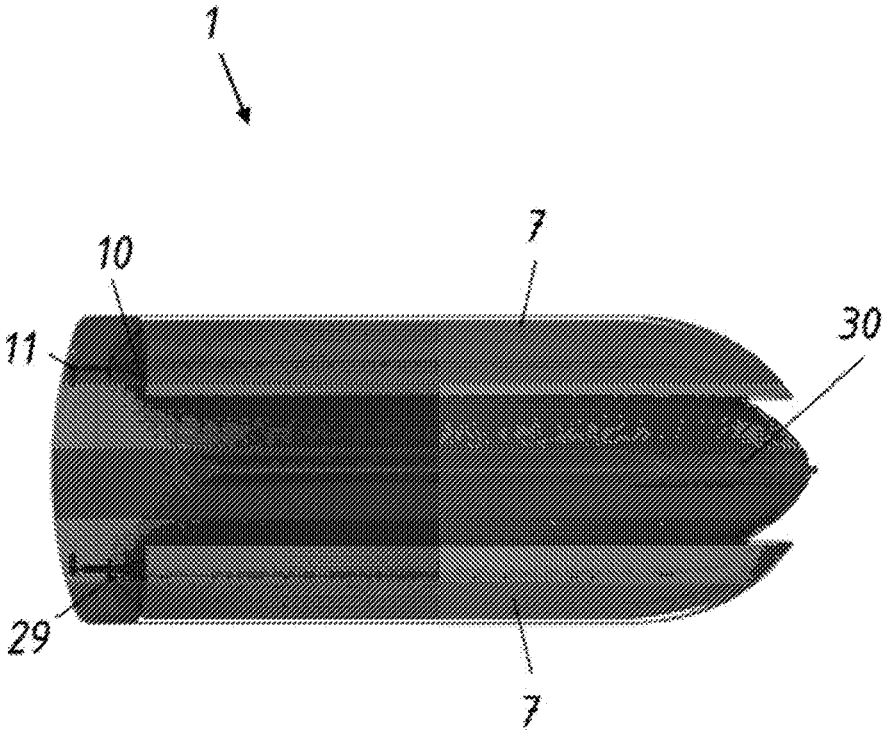
Figure 8:
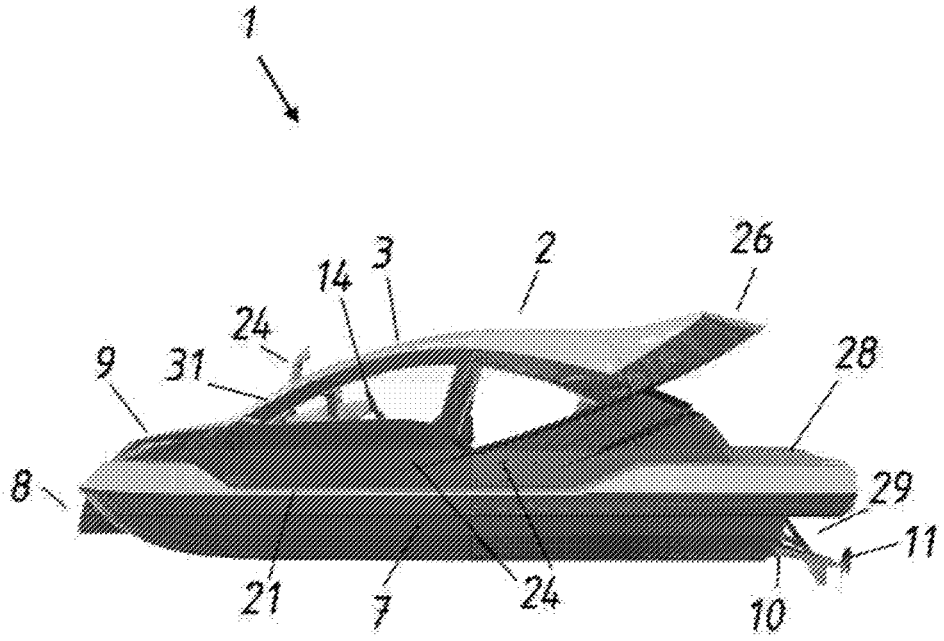
Figure 9:
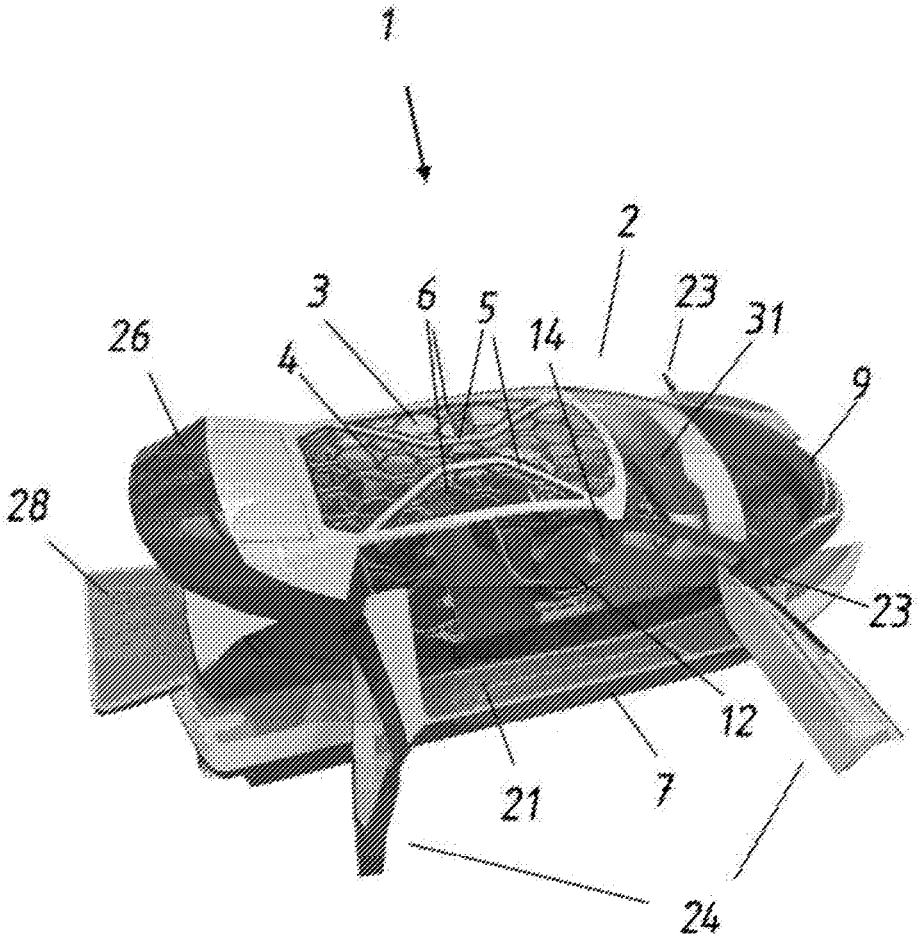
Figure 10:
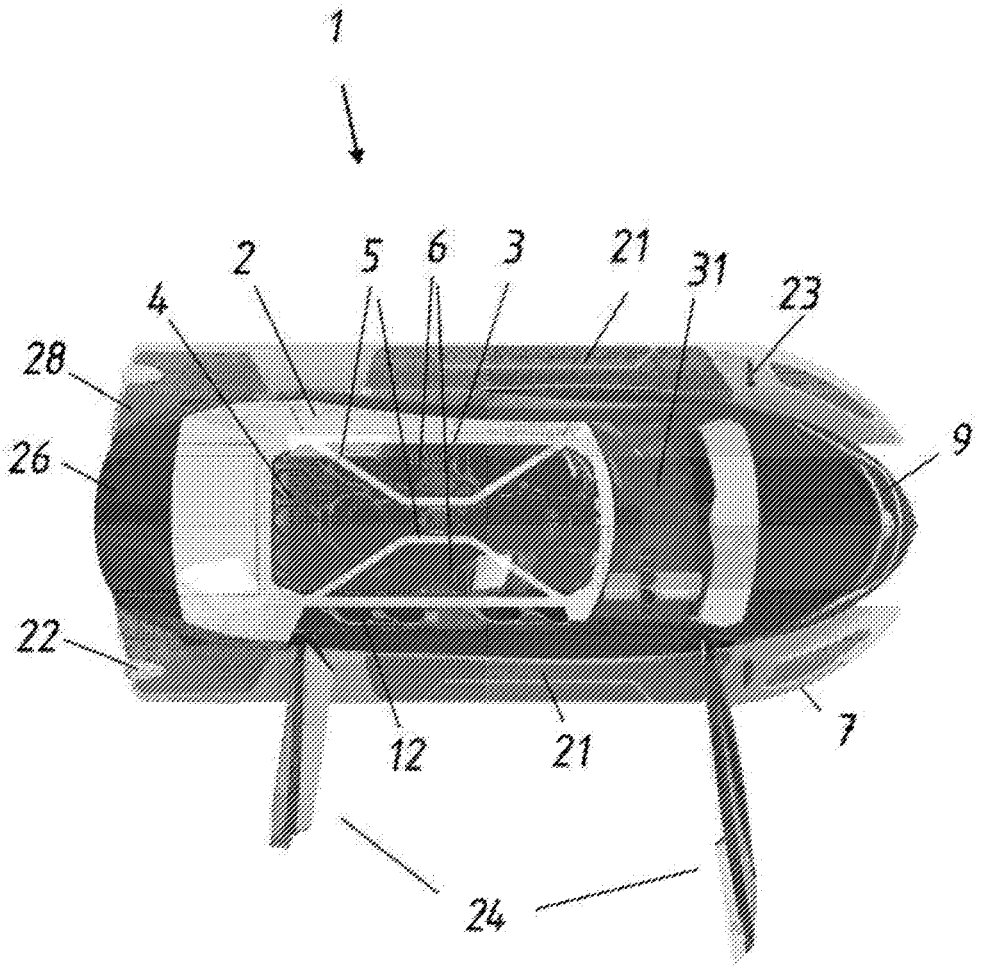
Figure 11:
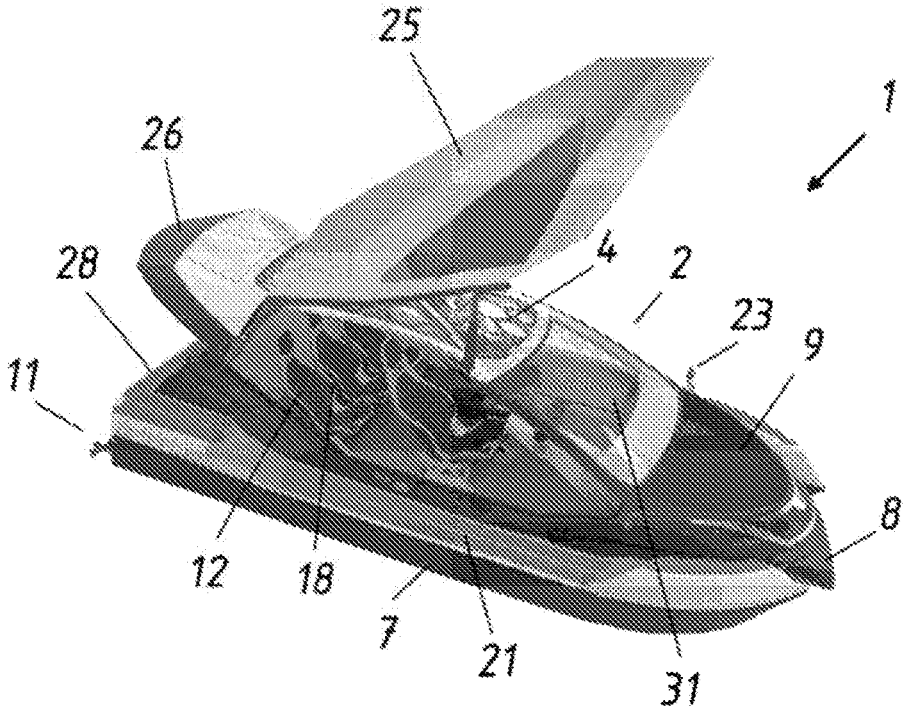
Figure 12:
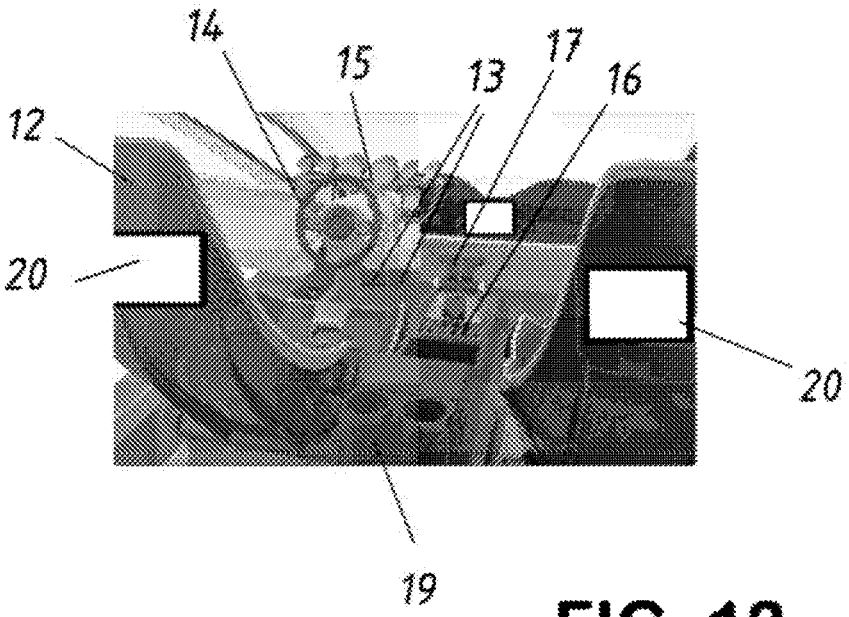

(51) Int. Cl.

| | |
|---|---|
| ***B63B 19/00*** | (2006.01) |
| ***B63B 19/08*** | (2006.01) |
| ***B63B 29/04*** | (2006.01) |
| ***B63B 45/02*** | (2006.01) |

(52) U.S. Cl.
CPC ..... *B63B 29/04* (2013.01); *B63B 45/02* (2013.01); *B63B 2019/0038* (2013.01); *B63B 2029/043* (2013.01); *B63B 2035/002* (2013.01)

(58) Field of Classification Search
CPC ..... B63B 2001/128; B63B 2001/203; B63B 2001/206; B63B 2001/208; B63B 1/06; B63B 19/02; B63B 19/19; B63B 19/12
See application file for complete search history.

(56) References Cited

U.S. PATENT DOCUMENTS

| | | | | | |
|---|---|---|---|---|---|
| 5,101,751 | A * | 4/1992 | Kobayashi | ..... | B63H 25/08 114/144 R |
| 5,584,355 | A * | 12/1996 | Burns | ..... | B60L 8/00 180/165 |
| 6,168,481 | B1 * | 1/2001 | Mardikian | ..... | B63B 1/042 114/151 |
| 2016/0332700 | A1 * | 11/2016 | Huetz | ..... | B63B 1/10 |
| 2017/0274973 | A1 * | 9/2017 | Tamura | ..... | B63H 21/14 |

* cited by examiner

URBAN WATERCRAFT

This aims at the presentation of the descriptive report of the patent application of an urban watercraft utility model, which belongs to the industrial sector of nautical vehicles for transportation of crew and passengers in general, bringing relevant improvement and advantages to similar and conventional known and existing crafts in the sector, adding important practical, functional, ergonomic solutions of better use and versatility, providing better safety, comfort, convenience, and further optional conditions to its users.

More precisely, the aforementioned urban watercraft was idealized, projected and developed in a way to improve the conditions of mobility in navigable areas of great urban centers, providing a convenient automotive water vehicle, attractive and absolutely safe, being non-submersible due to the filling of parts of the structure of the hull (catamaran) which are equipped with polystyrene of greater hardness and buoyancy, and yet incorporating a series of utilitarian characteristics combined with devices and mechanisms which offer great simplicity, speed and practicality, since the embark, route and disembark, to all of those who make use of it, or pilot it.

As commonly known, the vast majority of urban centers is completely saturated and congested with conventional automotive vehicles which, besides generating pollution, also incur high costs due to waste of time, investments in control, administrative expenses with supporting agents, accidents and a series of other inconveniences, so the solution presented here can greatly improve the process of urban mobility, notably in regions with minimal conditions for navigability.

This craft fully serves the transportation of passengers in general, either for work, research, leisure, sightseeing, recreation, business, professional ends, patrolling or other types of adequate activities which have to be developed in urban areas with fluvial and coastal waters of shallow depth, but available for navigation.

Produced substantially in glass fiber, it presents structural reinforcement in the areas of greater strain and tension during navigation, such as the catamaran hulls, engine and propeller compartments, areas for embark and disembark, and in the inverted bow.

It has combustion, electric or hybrid water jet high performance engines or surface propeller for navigation on shallow waters, providing optimized speed (about 60 mph), maintaining improved disposition and internal comfort in relation to the conventional automotive vehicles, such as independent seats, seat belts, airbags, a piloting system with acceleration and braking pedals, a steering wheel, a dashboard, a central console with multimedia sound and a gear shift lever, front and reverse.

In order to provide greater comfort and convenience, the ergonomic seats have armrests and cupholders, besides facilities such as internet/Wi-Fi access, detachable tablets and front consoles for those positioned in the front.

It also has a lateral boarding platform system for the comfort of the passengers during the process of embark and disembark, as well as a system of headlights and lateral arrows in the camera-based rearview mirrors.

The navigability structure is composed of a platform (hull) and a closed cab (deck) with air conditioning, over a pneumatic suspension system with adjustable airbags and hydrogen-based shock absorbers, located between its hull structure (catamaran hulls) and deck (central cab), offering greater comfort in comparison to conventional automotive vehicles.

It comprises a system of four individual flap doors (front and back), also offering an optional feature of the opening of two wide gullwing lateral doors (upwards), which need less lateral space for their moving, besides providing wider opening for the comfort of the passengers in the embark and disembark.

It also features a system of negative bow (inverted nose ahead) that maintains the craft constantly in contact with water, even in high speed or in unstable water conditions and of less navigability, such as in coastal waters.

It has an upper airfoil system over rear window for the setting of antennae and instruments, as well as rear folding platform and with step over the propellers, for leisure, embark and disembark.

The craft features high performance hull of fast gliding with the use of pairing engines (on both catamaran hulls) with surface propelling helix or hydro jet for greater performance and lower draught (water depth), with central 'watershad' system in the hulls (water shed) for gliding and sliding on water over the hulls when in movement, besides the system of panoramic frontal glass, frontal hood with trunk and access to fuel supply, camera-based rear mirrors with arrows and frontal headlights, rear window under the airfoil, rear camera for external visualization and for watching the practice of water sports in tablets, and other activities, as well as eventual external abnormalities which might be within the camera reach.

In view of that, it should be emphasized that this detailed description is carried out through the use of representative illustrations of the aforementioned urban watercraft, in such a way that it can be adequately used, allowing full characterization of the functionality of what is pleaded, where the descriptive part of the report is based on the use of the elaborated illustrations which express the best or preferable shape of executing what was idealized, with detailed and consecutive numbering, where it clarifies aspects which might be implied in the adopted representation, aiming at determining the protection clearly and may vary in different aspects, such as dimension, material, shape and others, as long as they do not escape the scope of what is revealed.

Thus, the patent application in question brings an urban watercraft especially projected and developed with the aim of having enormous practicality, gathering greater advantage, both in its use and production, with low costs for its operational feasibility, in tandem with, however, the requests of robustness, ergonomics and simplicity of use.

In this sense and aiming at a better understanding and comprehension of how the nautical vehicle is composed in the present description, it is represented in the following illustrations and main faces:

illustration 1: outward-frontal perspective;
illustration 2: upper-lateral perspective;
illustration 3: post-superior and lateral perspective
illustration 4: rear view;
Illustration 5: frontal perspective;
illustration 6: front view;
illustration 7: lower view;
Illustration 8: side view;
illustration 9: upper-lateral view in perspective, with double side doors (front and rear) open from one side of the watercraft, where it is also possible to visualize the arrangement of the internal ergonomic seats;
Illustration 10: top view, with the double side doors (front and rear) open from one side of the watercraft;

illustration 11: lateral and upper-frontal perspective views, exemplifying the opening and access to the cab through the largest optional door (one on each side), which flaps up, and not sideways;

Illustration 12: partial and detailed view of the interior of the cab showing the pilot cockpit which is similar, but improved compared to those known in conventional automotive vehicles, also provided with a series of assistance devices, comfortable and entertaining to the users.

In accordance with the illustrations, and in compliance with the description provided, this patent application refers to a utility model of urban watercraft which belongs to the industrial sector of nautical vehicles for the transportation of crew and passengers in general, composed of a speedboat (1) equipped with a central cab (2), with roof made of transparent material (3) and a honeycomb grid (4) under an X-shaped structure (5) and delimiting faceted areas (6). This speedboat is produced substantially in glass fiber and it presents structural reinforcement in the areas of greater strain and tension during navigation, such as the catamaran hulls (7), engines and propellers compartments, areas for embark and disembark and in the inverted nose (8) of the negative bow (9), and it also has electric or hybrid water jet high performance engines (10) or surface propeller (11), ergonomic independent seats (12), seat belts, airbags, a steering system with acceleration and braking pedals (13), a steering wheel (14), a dashboard (15), a central console (16) with multimedia sound and a gear shift lever (17), front and reverse, armrests (18), cupholders (19), Internet/Wi-Fi connection, detachable tablets (20), a lateral boarding platform (21), headlights (22) and lateral arrows in the camera-based rearview mirrors (23), an air-conditioning system, a pneumatic suspension system with adjustable airbags and hydrogen-based shock absorbers, located between its hull structure (catamaran hulls) and deck (central cab), four individual flap doors (front and back) (24), also offering an optional feature of the opening of two wide gullwing lateral doors (upwards) (25), negative bow (9) (inverted with nose 8 ahead), an upper airfoil (26) over read window (27), a foldable rear platform (28) with step over the propellers (29), central 'watershad' system (30) in the hulls (water shed), a panoramic front window (31), a front hood with luggage compartment and access to fuel supply, a rear camera (32).

It should be noted that although the patent application was described herein with reference to the desired mode, those who are skilled in the art shall notice that other modifications might be carried out, including in connection with the use and/or combination of materials which are diverse and resistant, in various dimensions, such characteristics being duly covered by this provision, without distancing from the spirit and scope of what has been explained.

Therefore, and in accordance with was described and illustrated, it is noted that the aforementioned urban vessels bring significant advantages to what is intended, perfectly fitting the criteria which define the utility model, once it combines and modifies elements already known, adding new form or disposition, resulting in functional improvement in its use or in its fabrication, fulfilling the necessary requirements to the intended nature, due to the fact that it meets the idealized objectives fully, concomitantly involving novelty, inventive act and industrial application, making itself deserving of the privilege hereby pleaded.

The invention claimed is:

1. URBAN WATERCRAFT, characterized by conforming a speedboat (1) equipped with: a central cab (2), a transparent roof (3), a honeycomb grid (4) under an X-shaped structure (5) and delimiting faceted areas (6), catamaran hulls (7), an inverted nose (8), negative bow (9), engines (10), propeller (11), seats (12), safety belts, airbags, acceleration and braking pedals (13), steering wheel (14), dashboard (15), central console (16), a gear shift lever (17), armrests (18), cupholders (19), internet/Wi-F access, detachable tablets (20), a lateral boarding platform (21), headlights (22) and lateral arrows in the camera-based rearview mirrors (23), an air-conditioning system, a pneumatic suspension system with adjustable airbags and hydrogen-based shock absorbers, Individual (rear and front) lateral doors (24), large gullwing lateral doors (25), an upper airfoil (26), a rear window (27), a foldable rear platform (28) with a step over the propelling devices (29), a central watershed system (30), a panoramic front window (31), a front hood over a luggage compartment and an access to fuel supply, a rear camera (32).

* * * * *